US005329341A

United States Patent [19]

Nowak et al.

[11] Patent Number: 5,329,341

[45] Date of Patent: Jul. 12, 1994

[54] OPTIMIZED VIBRATORY SYSTEMS IN ELECTROPHOTOGRAPHIC DEVICES

[75] Inventors: William J. Nowak, Webster; David B. Montfort, Penfield; Ronald E. Stokes, Fairport, all of N.Y.

[73] Assignee: Xerox Corporation, Stamford, Conn.

[21] Appl. No.: 102,928

[22] Filed: Aug. 6, 1993

[51] Int. Cl.[5] ..... G03G 15/14

[52] U.S. Cl. ..... 355/273; 355/271

[58] Field of Search ..... 355/212, 271, 273, 274, 355/276, 296; 118/652; 15/1.51, 256.5, 256.53; 134/1; 310/310, 325

[56] References Cited

U.S. PATENT DOCUMENTS

| | | | |
|---|---|---|---|
| T893,001 | 12/1971 | Fisler | 134/1 |
| 3,113,225 | 12/1963 | Kleesattel et al. | 310/26 |
| 3,190,793 | 6/1965 | Starke | 162/278 |
| 3,422,479 | 1/1969 | Jeffee | 15/100 |
| 3,483,034 | 12/1969 | Ensminger | 134/1 |
| 3,635,762 | 1/1972 | Ott et al. | 134/1 |
| 3,653,758 | 4/1972 | Trimmer et al. | 355/273 |
| 3,713,987 | 1/1973 | Low | 435/294 |
| 3,733,238 | 5/1973 | Long et al. | 156/580 |
| 3,854,974 | 12/1974 | Sato et al. | 430/126 |
| 4,007,982 | 2/1977 | Stange | 355/299 |
| 4,111,546 | 9/1978 | Maret | 355/297 |
| 4,121,947 | 10/1978 | Hemphill | 134/1 |
| 4,363,992 | 12/1982 | Holze, Jr. | 310/323 |
| 4,546,722 | 10/1985 | Toda et al. | 118/657 |
| 4,684,242 | 8/1987 | Schultz | 355/307 |
| 4,794,878 | 1/1989 | Connors et al. | 118/653 |
| 4,833,503 | 5/1989 | Snelling | 355/259 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski et al. | 355/273 |
| 5,025,291 | 6/1991 | Nowak et al. | 355/273 |
| 5,030,999 | 7/1991 | Lindblad et al. | 355/297 |
| 5,081,500 | 1/1992 | Snelling | 355/273 |
| 5,210,577 | 5/1993 | Nowak | 355/273 |

FOREIGN PATENT DOCUMENTS

| | | | |
|---|---|---|---|
| 2280115 | 8/1976 | France . | |
| 52-37042 | 3/1977 | Japan | 355/273 |
| 62-195685 | 8/1987 | Japan . | |

OTHER PUBLICATIONS

Xerox Disclosure Journal, "Floating Diaphragm Vacuum Shoe", Hull et al., vol. 2, No. 6, Nov./Dec. 1977; pp. 117-118.

*Primary Examiner*—A. T. Grimley
*Assistant Examiner*—William J. Royer
*Attorney, Agent, or Firm*—Mark Costello

[57] ABSTRACT

An electrophotographic device for reproducing an image on an imaging member includes: processing elements for forming a toner-developed latent image on a charge retentive surface of the imaging member; a transfer station for transferring toner from the imaging surface to a second surface of a receiving member; an arrangement for enhancing toner release from the imaging surface, including a resonator in contact with and applying vibratory energy to the imaging member at a location at which toner release is desired having a resonator resonant frequency $f_r$; a coupler for coupling the imaging member to the resonator; a driving signal source electrically coupled to the resonator, and producing a driving signal selected to drive the resonator at frequency $f_r$; the imaging member, coupler and receiving member together defining a system having a first and second belt resonant frequency ($f_{b1}$ and $f_{b2}$, respectively) when excited by the toner release enhancer; and the belt resonant frequencies and the resonator resonant frequency selected so that $$f_r=(f_{b1}+f_{b2})/2$$

10 Claims, 7 Drawing Sheets

OPTIMIZED VIBRATORY SYSTEMS IN ELECTROPHOTOGRAPHIC DEVICES

This invention relates to reproduction apparatus, and more particularly, to an apparatus for uniformly applying high frequency vibratory energy to an imaging surface for electrophotographic applications with optimal energy transfer.

INCORPORATION BY REFERENCE

The following United States patents are specifically incorporated by reference for their background teachings, and specific teachings of the principles of operation, construction and use of resonators for applying toner releasing vibrations to the charge retentive surfaces of electrophotographic devices: U.S. Pat. Nos. 5,210,577 to Nowak; 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; U.S. patent application Ser. No. 08/003906 "Cross Process Vibrational Mode Suppression in High Frequency Vibratory Energy Producing Devices for Electrophotographic Imaging" by W. Nowak et al.; and U.S. patent application Ser. No. 07/620,520, "Energy Transmitting Horn Bonded to an Ultrasonic Transducer for Improved Uniformity at the Horn Tip", by R. Stokes et al.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween. An electrostatic transfer charging device, such as a corotron, applies a charge to the back side of the sheet, to attract the toner image to the sheet.

Unfortunately, the interface between the sheet and the charge retentive surface is not always optimal. Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be non-uniform, characterized by gaps where contact has failed. There is a tendency for toner not to transfer across these gaps. A copy quality defect results.

That acoustic agitation or vibration of a surface can enhance toner release therefrom is known, as described by U.S. Pat. Nos. 4,111,546 to Maret, 4,684,242 to Schultz, 4,007,982 to Stange, 4,121,947 to Hemphill, Xerox Disclosure Journal "Floating Diaphragm Vacuum Shoe, by Hull et al., Vol. 2, No. 6, November/-December 1977, U.S. Pat. Nos. 3,653,758 to Trimmer et al., 4,546,722 to Toda et al., 4,794,878 to Connors et al., 4,833,503 to Snelling, Japanese Published Patent Application 62-195685, 3,854,974 to Sato et al., and French patent No. 2,280,115.

Resonators for applying vibrational energy to some other member are known, for example in U.S. Pat. Nos. 4,363,992 to Holze, Jr., 3,113,225 to Kleesattel et al., 3,733,238 to Long et al., and 3,713,987 to Low.

Coupling of vibrational energy to a surface has been considered in Defensive Publication T893,001 by Fisler. U.S. Pat. Nos. 3,635,762 to Ott et al., 3,422,479 to Jeffee, 4,483,034 to Ensminger and 3,190,793 Starke.

Resonators coupled to the charge retentive surface of an electrophotographic device at various stations therein, for the purpose of enhancing the electrostatic function, are known, as in: U.S. Pat. Nos. 5,210,577 to Nowak; 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; U.S. patent application Ser. No. 08/003906 "Cross Process Vibrational Mode Suppression in High Frequency Vibratory Energy Producing Devices for Electrophotographic Imaging" by W. Nowak et al., and U.S. patent application Ser. No. 07/620,520, "Energy Transmitting Horn Bonded to an Ultrasonic Transducer for Improved Uniformity at the Horn Tip", by R. Stokes et al. Among the problems addressed in these references are uniformity of vibration, coupling of energy, optimal positioning within the transfer field, and the use in association with cleaning devices.

All the references cited herein are specifically incorporated by reference for their teachings.

SUMMARY OF THE INVENTION

In accordance with the invention there is provided an electrophotographic device for the reproduction of images on an imaging member with toner, and vibratory energy applying means for enhancing release of toner from the imaging member, wherein the imaging member system resonant frequency and the operational frequency of the vibratory energy applying means are selected with knowledge of the other and to optimize toner release.

In accordance with one aspect of the invention, an electrophotographic device for reproducing an image on an imaging member includes: means for forming a toner-developed latent image on a charge retentive surface of the imaging member; means for transferring toner from the imaging surface to a second surface of a receiving member; means for enhancing toner release from the imaging surface, including a resonator in contact with and applying vibratory energy to the imaging member at a location at which toner release is desired having a resonator resonant frequency $f_r$; means for coupling the imaging member to the resonator; a driving signal source electrically coupled to the resonator, and producing a driving signal selected to drive the resonator at frequency $f_r$; the imaging member, the coupling means and the receiving member together defining a system having a first and second belt resonant frequency ($f_{b1}$ and $f_{b2}$, respectively) when excited by the toner release enhancing means; and the belt resonant frequencies and the resonator resonant frequency selected so that $$f_r \sim (f_{b1}+f_{b2})/2$$

In originally working with the combination resonator/belt system, it was believed that high energy efficiency within the system was required, and that the transducer and belt system resonances should coincide. This model failed to take into account the need to maintain tip and belt coupling. Experience with the arrangements described in U.S. Pat. Nos. 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; and U.S. patent application Ser. No. 07/620,520, "Energy Transmitting Horn Bonded to an Ultrasonic Transducer for Improved Uniformity at the Horn Tip", by R. Stokes et al., have taught that the transducer tip must remain in contact with the imaging member for uniform toner release enhancement. Noted was that variations in belt lengths (as defined by the vacuum coupler walls), materials and coupling tensions affected the response of the resonator/belt system. In one notable case, small differences in coupler wall spacing was the difference between wild and uncontrollable belt behavior and stable belt behavior conducive to good toner control. It was also observed that stable belt behavior cases required less applied vacuum to maintain tip/belt coupling, which in turn reduced belt drag and drive motor torque, leading to stress on the belt driving motors. This, in turn, improved photoreceptor motion quality.

Accordingly, the present invention is directed to providing a resonator/belt system where the resonator resonant frequency is approximately coincident with the belt system anti-resonance frequency.

U.S. Pat. No. 5,030,999 to Lindblad et al. assigned to the same assignee as the present invention, and specifically incorporated herein by reference suggests, preclean treatment enhancement by application of vibratory energy. The present invention finds use in this application as well.

These and other aspects of the invention will become apparent from the following description used to illustrate a preferred embodiment of the invention read in conjunction with the accompanying drawings in which.

Reproduction machines of the type contemplated for use with the present invention are well known and need not be described herein. U.S. Pat. Nos. 5,210,577 to Nowak; 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; U.S. patent application Ser. No. 08/003,906 "Cross Process Vibrational Mode Suppression in High Frequency Vibratory Energy Producing Devices for Electrophotographic Imaging" by W. Nowak et al., and U.S. patent application Ser. No. 07/620,520, "Energy Transmitting Horn Bonded to an Ultrasonic Transducer for Improved Uniformity at the Horn Tip", by R. Stokes et al. adequately describe such devices, and the application of transfer improving vibration inducing devices, and are specifically incorporated herein by reference.

Figure 1:
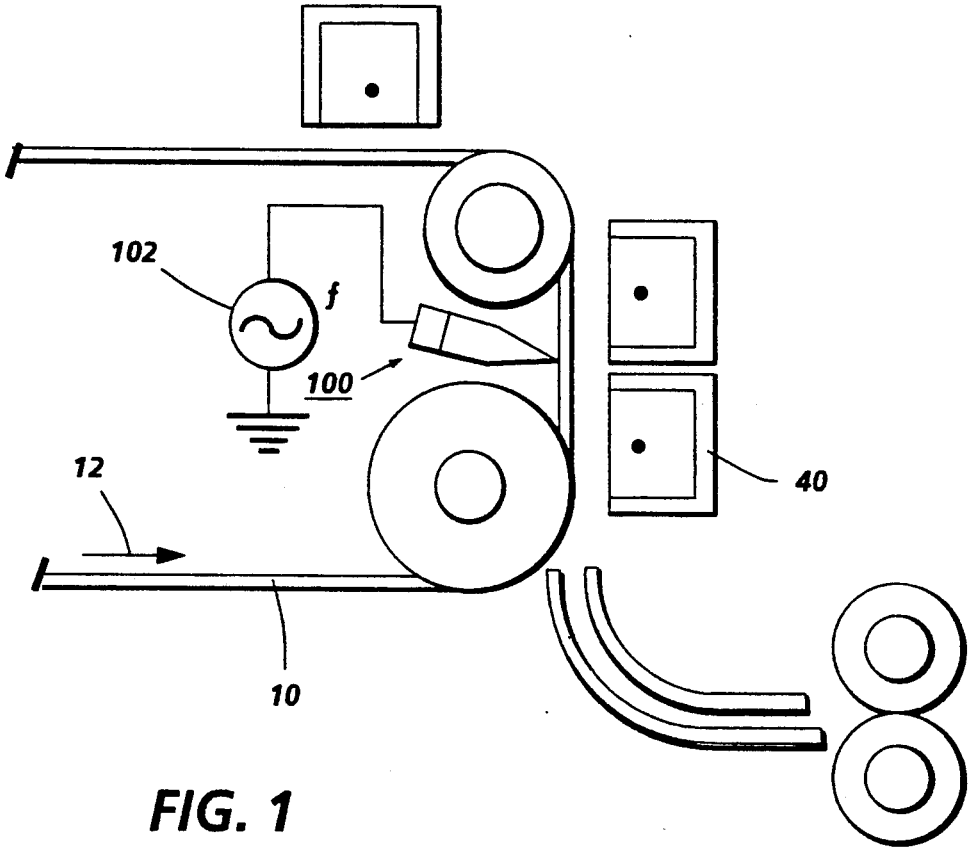
FIG. 1 is a schematic illustration of the transfer station and the associated ultrasonic transfer enhancement device of the invention.

With reference to FIG. 1, wherein a portion of a reproduction machine is shown including at least portions of the transfer, detack and precleaning functions thereof, the basic principle of enhanced toner release is illustrated, where a relatively high frequency acoustic or ultrasonic resonator 100 driven by an A.C. source 102 operated at a frequency f between 20 kHz and 200 kHz, is arranged in vibrating relationship with the interior or back side of an image receiving belt 10, at a position closely adjacent to where the belt passes through a transfer station. Vibration of belt 10 agitates toner developed in imagewise configuration onto belt 10 for mechanical release thereof from belt 10, allowing the toner to be electrostatically attracted to a sheet during the transfer step, despite gaps caused by imperfect paper contact with belt 10. Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 is optimal, resulting in improved toner use efficiency, and a lower load on the cleaning system. In a preferred arrangement, the resonator 100 is arranged with a vibrating surface parallel to belt 10 and transverse to the direction of belt movement 12, generally with a length approximately co-extensive with the belt width. The belt described herein has the characteristic of being non-rigid, or somewhat flexible, to the extent that it can be made to follow the resonator vibrating motion.

Figure 2A:
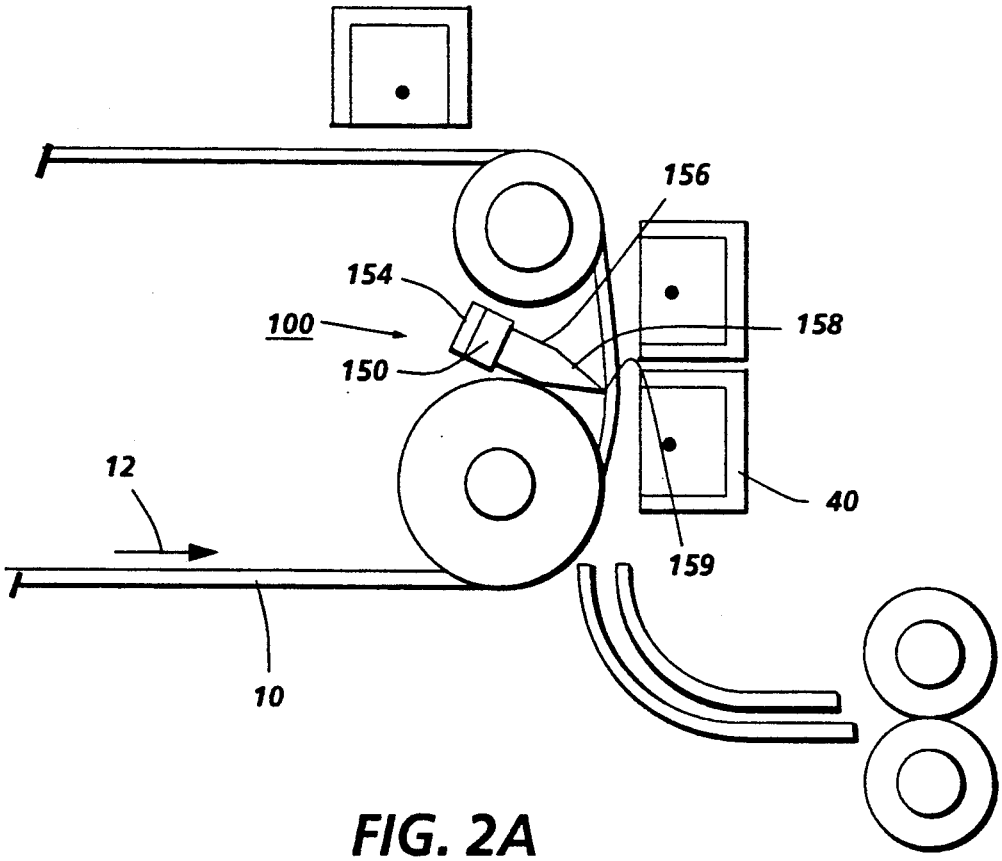
FIGS. 2A and 2B illustrate schematically two arrangements to couple an ultrasonic resonator to an imaging surface.
Figure 2B:
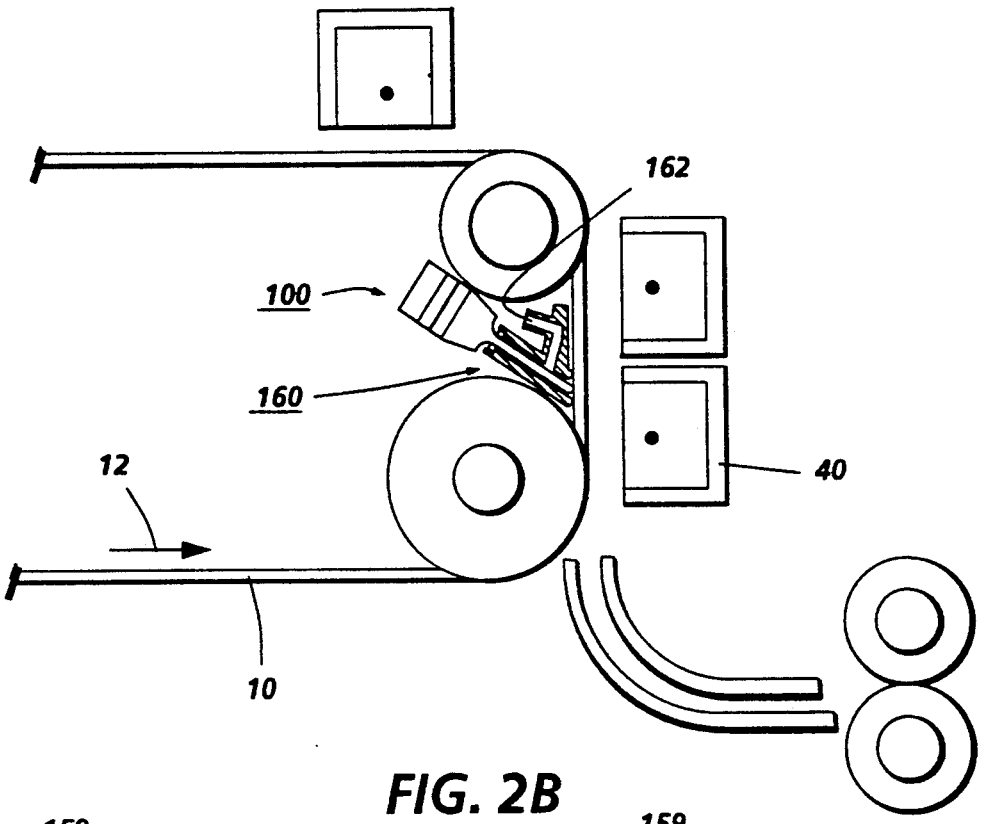
Figure 3:
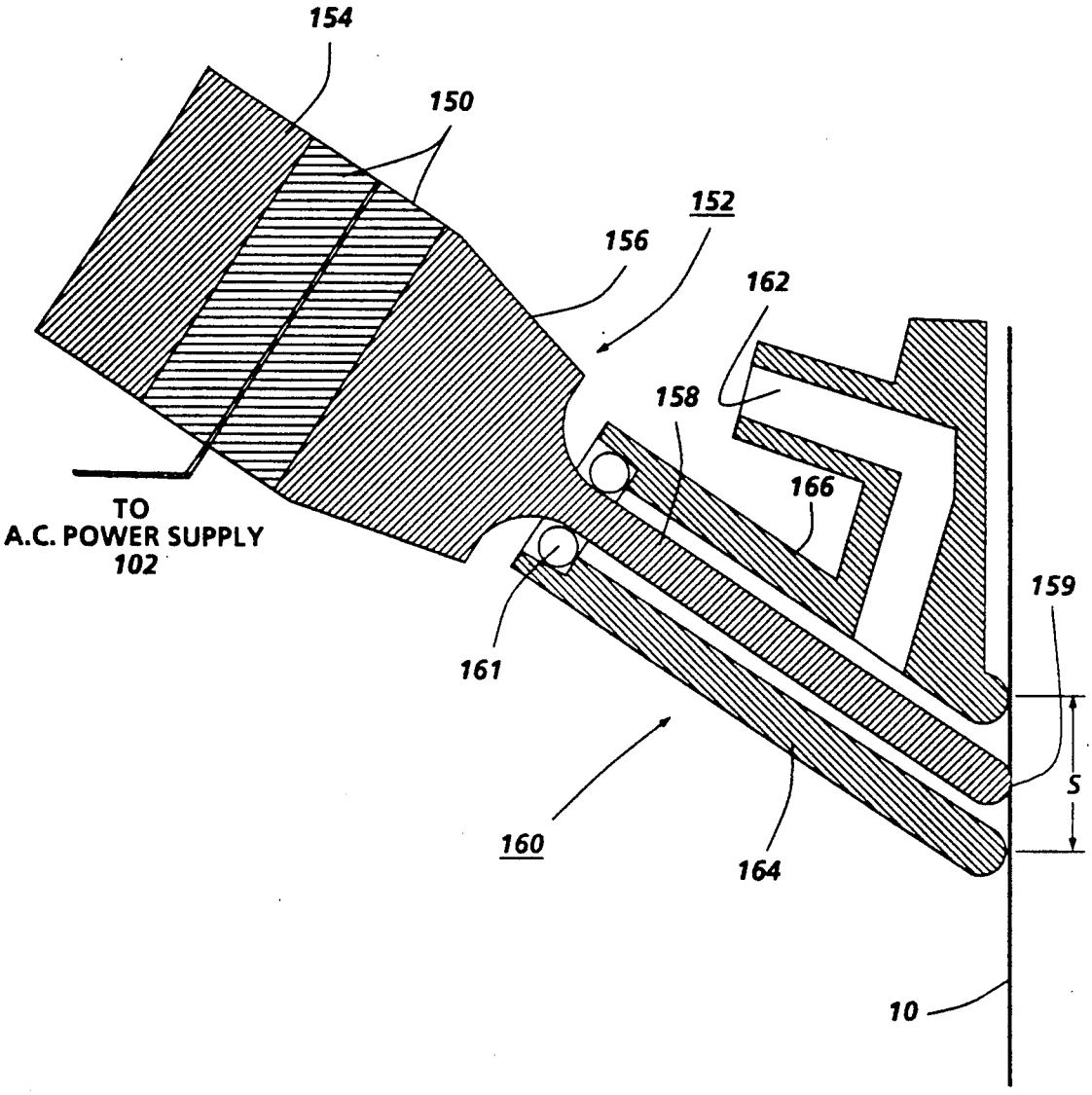
FIG. 3 is a cross sectional view of a vacuum coupling assembly in accordance with the invention.

With reference to FIGS. 2A and 2B, and better shown in FIG. 3, the vibratory energy of the resonator 100 may be coupled to belt 10 in a number of ways. In the arrangements shown, resonator 100 may comprise a piezoelectric transducer element 150 and horn 152, together supported on a backplate 154. Horn 152 includes a platform portion 156 and a horn tip 158 and a contacting tip 159 in contact with belt 10 to impart the ultrasonic energy of the resonator thereto. To hold horn 152 and the piezoelectric transducer element 150, an adhesive such as an epoxy and conductive mesh layer may be used to bond the horn and piezoelectric transducer element together. In a working example, the mesh was a nickel coated monofilament polyester fiber (from Tetko, Inc.) with a mesh thickness on the order of 0.003" thick encapsulated in a thermosetting epoxy having a thickness of 0.005" (before compression and heating). Other meshes, including metallic meshes of phosphor bronze and Monel may be satisfactory. Two part cold setting epoxies may also be used, as may other adhesives. Alternatively, a bolt and nut arrangement may be used to clamp the assembly together.

In the fabrication of the arrangement, the epoxy and conductive mesh layer are sandwiched between the horn and piezoelectric material, and clamped to ensure good flow of the epoxy through the mesh and to all surfaces. It appears to be important that the maximum temperature exposure of the PZT be about 50% of its curie point. Epoxies are available with curing temperatures of 140°, and piezoelectric materials are available from 195° to 350°. Accordingly, an epoxy-PZT pair is preferably selected to fit within this limitation.

The contacting tip 159 of horn 152 may be brought into a tension or penetration contact with belt 10, so that movement of the tip carries belt 10 in vibrating motion. Penetration can be measured by the distance that the horn tip protrudes beyond the normal position of the belt, and may be in the range of 1.5 to 3.0 mm. It should be noted that increased penetration produces a ramp angle at the point of penetration. For particularly stiff sheets, such an angle may tend to cause lift at the trail edges thereof.

As shown in FIG. 2B, to provide a coupling arrangement for transmitting vibratory energy from a resonator 100 to photoreceptor 10, the resonator may be arranged in association with a vacuum box arrangement 160 and vacuum supply 162 (vacuum source not shown) to provide engagement of resonator 100 to photoreceptor 10 without penetrating the normal plane of the photoreceptor.

FIG. 3 shows an assembly arranged for coupling contact with the backside of imaging receiving surface 10, which presents considerable spacing concerns. Accordingly, horn tip 158 extends through a generally air tight vacuum box 160, which is coupled to a vacuum source such as a diaphragm pump or blower (not shown) via outlet 162 formed in one or more locations along the length of upstream or downstream walls 164 and 166, respectively, of vacuum box 160. Walls 164 and 166 are approximately parallel to horn tip 158, extending to approximately a common plane with the contacting tip 159, and forming together an opening in vacuum box 160 adjacent to the photoreceptor belt 10, at which the contacting tip contacts the photoreceptor. The vacuum box is sealed at either end (inboard and outboard sides of the machine) thereof (not shown). The entry of horn tip 158 into vacuum box 160 is sealed with an elastomer sealing member 161, which also serves to isolate the vibration of horn tip 158 from wall 164 and 166 of vacuum box 160. When vacuum is applied to vacuum box 160, via outlet 162, belt 10 is drawn into contact with walls 164 and 166 and contacting tip 159, so that contacting tip 159 imparts the ultrasonic energy of the resonator to belt 10. Interestingly, walls 164 or 166 of vacuum box 160 also tend to damp vibration of the belt outside the area in which vibration is desired, so that the vibration does not disturb the dynamics of the sheet tacking or detacking process, or the integrity of the developed image prior to the transfer field.

With reference to FIG. 2B and 3, application of high frequency acoustic or ultrasonic energy to belt 10 occurs within the area of application of transfer field, and preferably within the area under transfer corotron 40. While transfer efficiency improvement appears to be obtained with the application of high frequency acoustic or ultrasonic energy throughout the transfer field, in determining an optimum location for the positioning of resonator 100, it has been noted that transfer efficiency improvement is strongly a function of the velocity of the contacting tip 159. The desirable position of the resonator is approximately opposite the centerline of the transfer corotron. For this location, optimum transfer efficiency was achieved for tip velocities in the range of 300–500 mm/sec. depending on toner mass. At very low tip velocity, from 0 mm/second to 45 mm/sec, the positioning of the transducer has relatively little effect on transfer characteristics. Restriction of application of vibrational energy, so that the vibration does not occur outside the transfer field is preferred. Application of vibrational energy outside the transfer field tends to cause greater electromechanical adherence of toner to the surface creating a problem for subsequent transfer or cleaning.

Figure 4A:
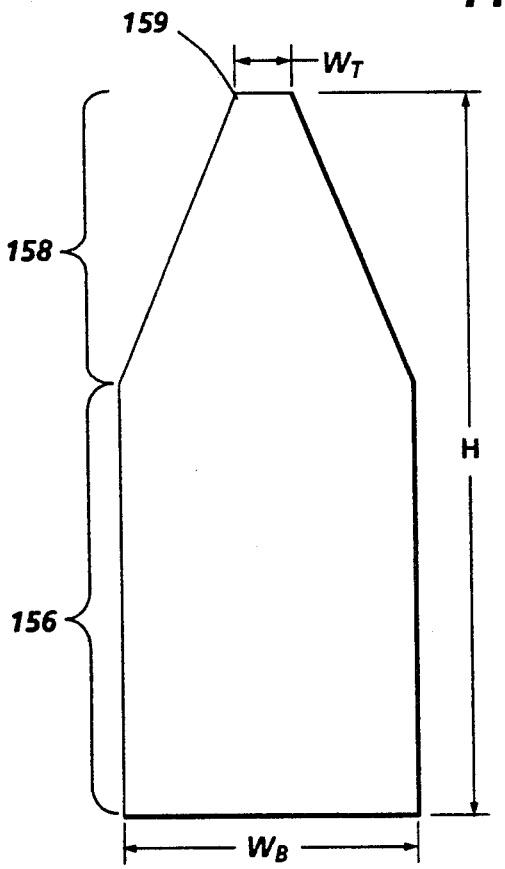
FIGS. 4A and 4B are cross sectional views of two types of horns suitable for use with the invention.
Figure 4B:
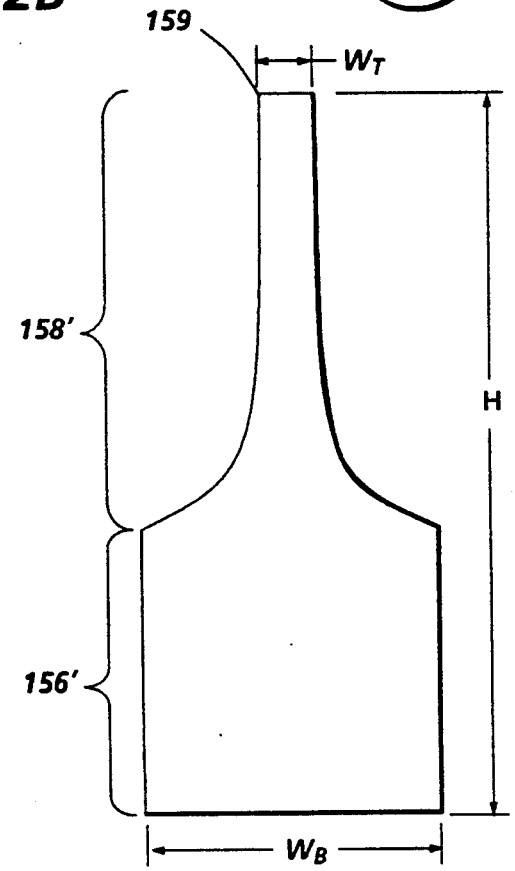

At least two shapes for the horn have been considered. With reference to FIG. 4A, in cross section, the horn may have a trapezoidal shape, with a generally rectangular base 156 and a generally triangular tip portion 158, with the base of the triangular tip portion having approximately the same size as the base. Alternatively, as shown in FIG. 4B, in cross section, the horn may have what is referred to as a stepped shape, with a generally rectangular base portion 156', and a stepped horn tip 158'. The trapezoidal horn appears to deliver a higher natural frequency of excitation, while the stepped horn produces a higher amplitude of vibration. The height H of the horn appears to have an effect on the frequency and amplitude response. Desirably the height H of the horn will fall in the range of approximately 1 to 1.5 inches (2.54 to 3.81 cm), with greater or lesser lengths not excluded. The ratio of the base width $W_B$ to tip width $W_T$ also effects the amplitude and frequency of the response with a higher ratio producing a marginally higher frequency and a greater amplitude of vibration. The ratio of $W_B$ to $W_T$ is desirably in the range of about 3:1 to about 10:1. The length L of the horn across belt 10 also effects the uniformity of vibration, with the longer horn producing a less uniform response. A desirable material for the horn is aluminum. Satisfactory piezoelectric materials, including lead zirconate-lead titanate composites sold under the trademark PZT by Vernitron, Inc. (Bedford, Ohio), have high $D_{33}$ values. Suitable materials may also be available from Motorola Corporation, Albuquerque, N. Mex. Displacement constants are typically in the range of 400–500 $^{m}/_{v} \times 10^{-12}$. There may be other sources of vibrational energy, which clearly support the present invention, including but not limited to magnetostriction and electrodynamic systems.

Figure 5:
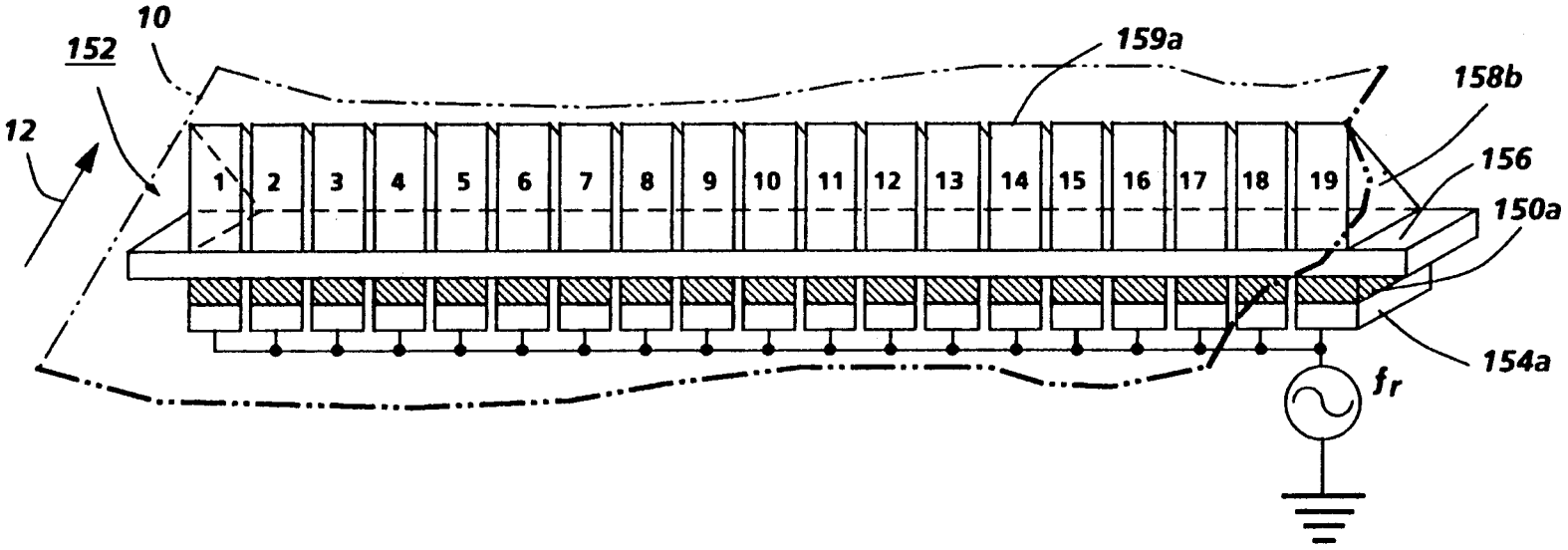
FIG. 5 is a perspective view of a resonator shown in operational relationship to a photoreceptor belt.

FIG. 5 shows a perspective view of one possible resonator (without the vacuum coupler). Illustrated is a fully segmented horn 152, cut through the contacting tip 159*a* of the horn and through tip portion 158*b*, with a continuous platform 156, a segmented piezoelectric element 150*a* and segmented backing plate 154*a*. The segmented piezoelectric element 150*a* are driven with a voltage signal having frequency $f_r$.

In accordance with the invention, experience with the arrangements described in U.S. Pat. Nos. 5,030,999 to Lindblad et al.; 5,005,054, to Stokes et al.; 4,987,456 to Snelling et al.; 5,010,369 to Nowak et al.; 5,025,291 to Nowak et al.; 5,016,055 to Pietrowski et al.; 5,081,500 to Snelling; and U.S. patent application Ser. No. 07/620,520, "Energy Transmitting Horn Bonded to an Ultrasonic Transducer for Improved Uniformity at the Horn Tip", by R. Stokes et al., have taught that the transducer tip 159 must remain in contact with belt 10 for uniform toner release enhancement. Noted was that variations in active belt length S (defined by the vacuum coupler walls 164, 166), materials and coupling tensions dramatically affected the response of the resonator/belt system.

The combination of elements including belt 10 and coupler walls 164 and 166 define a belt system having a particular resonant frequency, $f_b$ i.e. a frequency of maximum amplification. In most cases there will be multiple frequencies $f_{b1}$, $f_{b2}$, $f_{b3}$ at which this phenomenon occurs. Variation of the resonant frequency of this belt system $f_b$ results from changing the wall spacing S, where a typical spacing may be about 6.8 to 8.5 mm. Further variation of the resonant frequency is obtained through change of thickness or stiffness of the belt 10 material. Yet further change occurs when a sheet of paper or other image receiving material passes through the system in intimate contact with the belt 10.

Figure 6A:
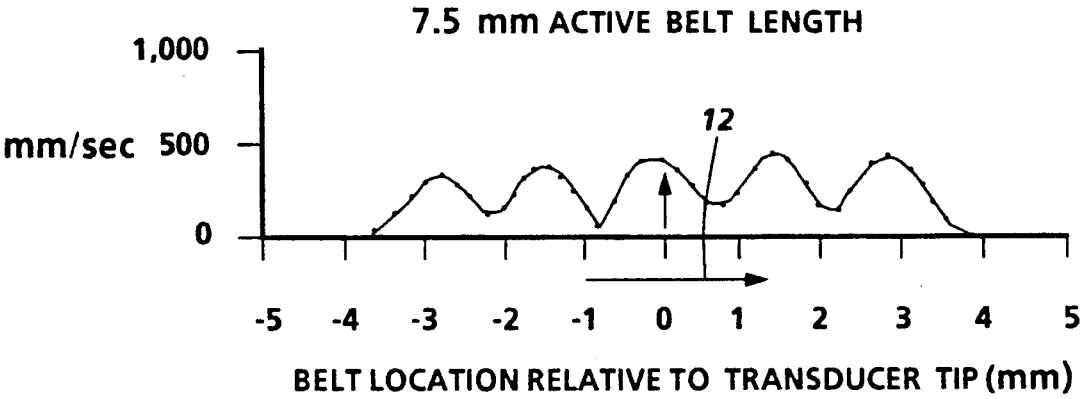
FIGS. 6A and 6B show the respective responses of the resonator with different active belt lengths.
Figure 6B:
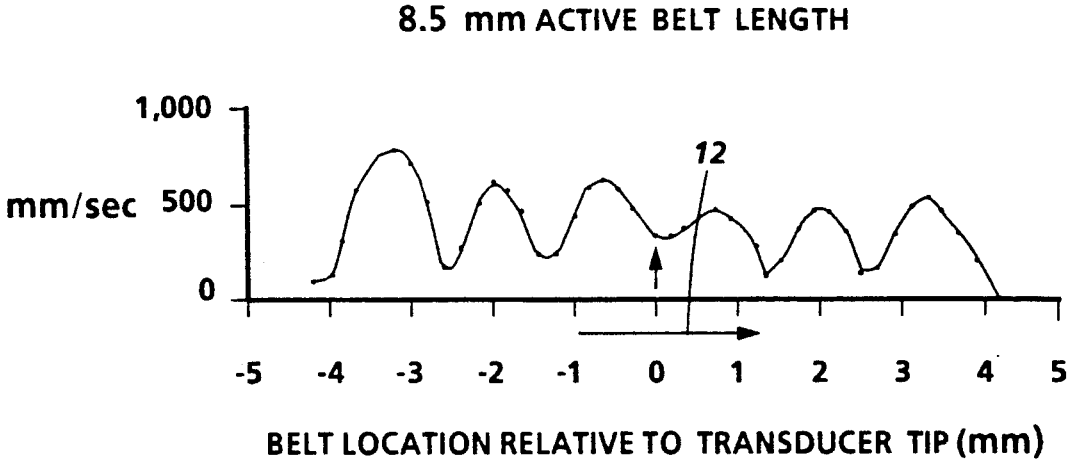

In one example case, with a photoreceptor belt provided with an active length (corresponding to spacing S) of 7.5 mm, the belt system was empirically measured to have resonances at 43 Khz and 82 Khz, deriving an anti-resonant frequency of about $f_{b1}+f_{b2}/2$ or 62.5 Khz. In the example and referencing FIG. 6A, good system operation was noted with a resonator designed to operate at a resonant frequency of about 62 KHz. However, in the same example, when the active length was increased to 8.5 mm, the resonance of the belt system was increased to 64 KHz. This is very close to the resonator resonance. With reference to FIG. 6B, non symmetric and unstable oscillation appeared as a result. It should also be noted that certain belt resonances (not shown in FIG. 8) are asymmetric in shape, and vertical transducer motion does not excite the belt. Accordingly, no consideration is given to these resonances.

Figure 7A:
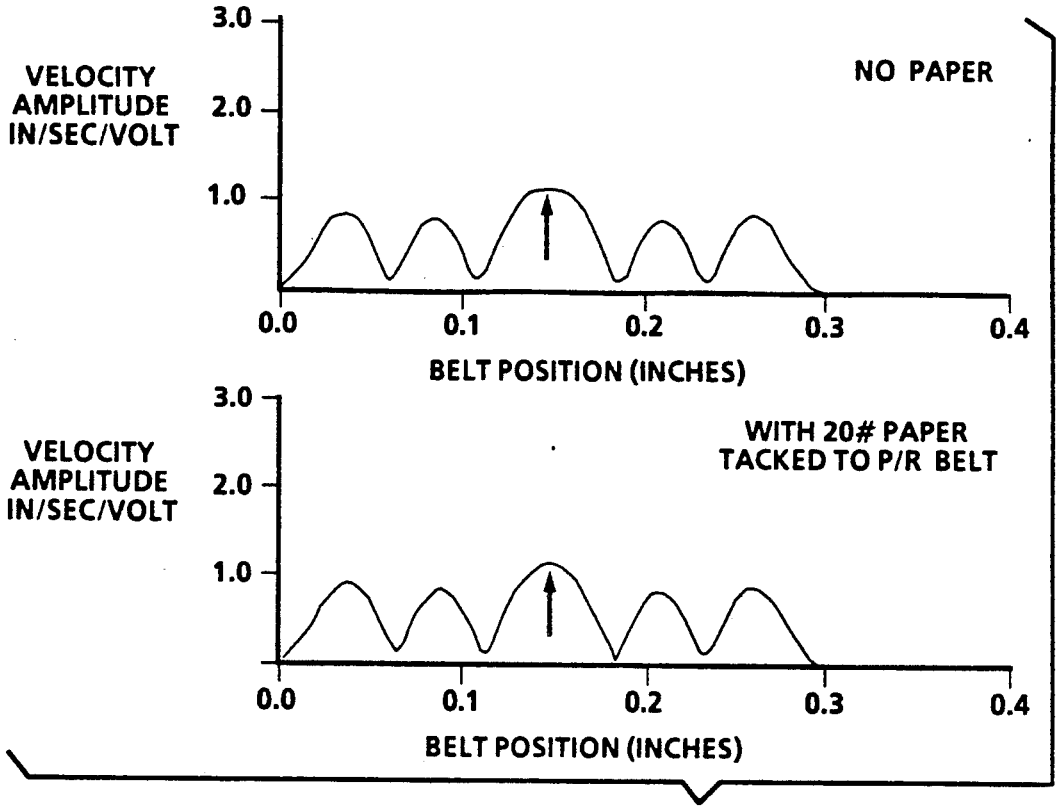
FIGS. 7A and 7B show the respective responses of the resonator with different active belt lengths and with and without paper tacked to the belt.

It can be seen that, in general, the system should be designed so that standard operation thereof places $f_r$ about or approximately the anti-resonance frequency for the belt system. With reference to FIG. 7A, if the system is designed so that that $f_r$ is about or approximately the anti-resonance frequency for the belt system when the system is not handling paper, upon tacking 20 lb paper to the example photoreceptor, little change in velocity amplitude is noted. However, with reference to FIG. 7B, if the system is designed so that that $f_r$ is close to resonance for the belt system when the system is not handling paper, upon tacking 20 lb paper to the example photoreceptor, significant change in velocity amplitude is noted.

Figure 7B:
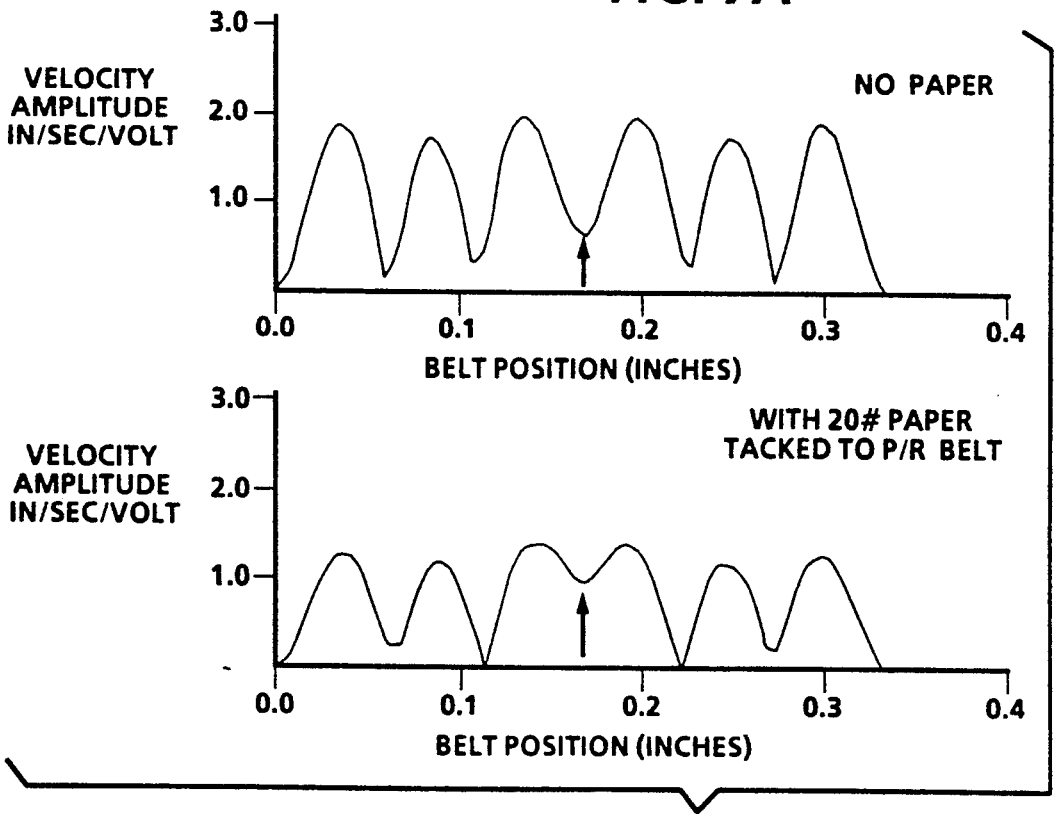

It should be clear from FIGS. 7A and 7B that it is highly desirable to place the resonator resonance in the middle of the range between two adjacent belt system resonant frequencies. The primary requirement is latitude with changing papers and machine operating conditions.

Figure 8:
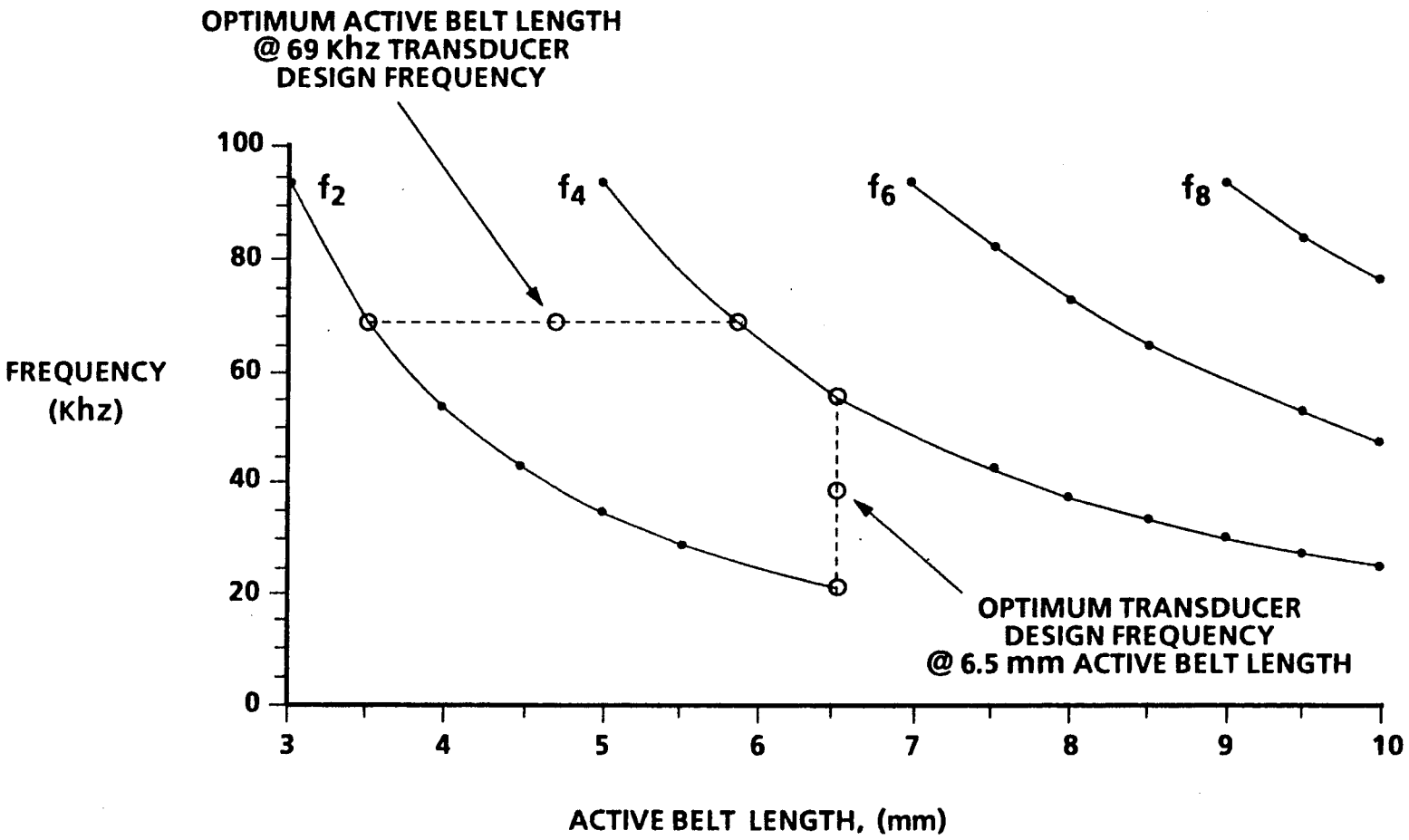
FIG. 8 shows the design scheme suggested by the present invention.

A more generalized view of the resonator belt system design is shown in FIG. 8. If belt resonance is calculated as a function of active belt length, a series of curves can be plotted as shown in FIG. 8 as $f_2$, $f_4$, $f_6$, $f_8$. If the design space requires a given resonator frequency, (recalling that the resonator resonant frequency is a function of its size and shape), the active belt length should be selected on a horizontal line midway between curves $f_2$, $f_4$, $f_6$, $f_8$. In an example, given a resonator operating at 69 KHz, belt length is optimally about 4.75 mm or 7.0 mm.

The resonant frequency of the resonator is primarily a function of the horn size. It will no doubt be recognized that a variable resonant frequency of the horn may be obtainable by changing certain size characteristics thereof. It is also possible to design a horn with multiple resonances. In such a case, the driving signal may be varied to produce the desired frequency. It may also be possible to arrange for an adjustable vacuum box, wherein one or both vacuum box walls 164 and 166 are selectively adjustable with respect to the other. These features have the characteristic of changing the respective resonances of the resonator and the belt system, to maintain the appropriate relationship of resonances.

It will no doubt be appreciated that the inventive resonator and vacuum coupling arrangement has equal application in the cleaning station of an electrophotographic device with little variation in structure.

As a means for improving uniformity of application of vibratory energy to a flexible member for the release of toner therefrom, the described resonator may find numerous uses in electrophotographic applications. One example of a use may be in causing release of toner from a toner bearing donor belt, arranged in development position with respect to a latent image. Enhanced development may be noted, with mechanical release of toner from the donor belt surface and electrostatic attraction of the toner to the image.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. An electrophotographic device for reproducing an image includes:

means for forming a toner-developed latent image on a charge retentive surface of an imaging member;

means for transferring toner from the charge retentive surface to a surface of a receiving member;

means for enhancing toner release from the charge retentive surface, including a resonator in contact with and applying vibratory energy to the imaging member at a location at which toner release is desired;

means for coupling the imaging member to the resonator;

a driving signal source electrically coupled to said resonator, and producing a driving signal selected to drive the resonator at a frequency $f_r$;

said imaging member and said coupling means together defining a system having a first and second belt resonant frequency ($f_{b1}$ and $f_{b2}$, respectively) when excited by the resonator; and said resonator operating frequency selected so that $$f_r \sim (f_{b1}+f_{b2})/2$$

2. The device as defined in claim 1, wherein said resonator comprises a piezoelectric element.

3. The device as defined in claim 1, wherein the resonator contacts the imaging member at a location closely adjacent from said toner transferring means.

4. The device as defined in claim 1, wherein a resonant frequency for the resonator is approximately $f_r$.

5. An electrophotographic device for reproducing an image comprising:

means for forming an toner-developed latent image on a charge retentive surface of an imaging member;

means for transferring toner from the charge retentive surface to a surface of a receiving member;

a resonator in contact with and applying vibratory energy to the imaging member at a location at which toner release from the charge retentive surface is desired;

a driving signal source electrically coupled to said resonator, and producing a driving signal selected to drive the resonator at a frequency $f_r$;

a vacuum box and associated vacuum source, substantially surrounding the resonator, and arranged to draw the imaging member into contact with the resonator;

said imaging member and said vacuum box together defining a system having a first and second system resonant frequency ($f_{b1}$ and $f_{b2}$, respectively) when excited by the resonator; and said resonator operating frequency selected so that $$f_r \sim (f_{b1}+f_{b2})/2$$

6. The device as defined in claim 5, wherein said resonator comprises a piezoelectric element.

7. The device as defined in claim 5, wherein the resonator contacts the imaging member at a location closely adjacent from said toner transferring means.

8. The device as defined in claim 5, wherein a resonant frequency for the resonator is approximately $f_r$.

9. An electrophotographic device for reproducing an image comprising:

an imaging member having a charge retentive surface and moving in an endless loop;

means for forming a toner-developed latent image on the charge retentive surface of the imaging member;

means for transferring toner from the charge retentive surface to a surface of a receiving member;

means for removing residual toner remaining on the charge retentive surface;

a resonator in contact with and applying vibratory energy to the imaging member at the residual toner removing means;

a driving signal source electrically coupled to said resonator, and producing a driving signal selected to drive the resonator at a frequency $f_r$;

a vacuum box and associated vacuum source, substantially surrounding the resonator, and arranged to draw the imaging member into contact with the resonator;

said imaging member and said vacuum box together defining a system having a first and second system resonant frequency ($f_{b1}$ and $f_{b2}$, respectively) when excited by the resonator; and said resonator operating frequency selected so that $$f_r \sim (f_{b1}+f_{b2})/2$$

10. The device as defined in claim 9, wherein a resonant frequency for the resonator is approximately $f_r$.

* * * * *